US006626372B2

(12) United States Patent
Boecking

(10) Patent No.: US 6,626,372 B2
(45) Date of Patent: Sep. 30, 2003

(54) INJECTOR WITH CONTROL PART GUIDANCE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 160 days.

(21) Appl. No.: 09/897,897

(22) Filed: Jul. 5, 2001

(65) Prior Publication Data

US 2002/0017576 A1 Feb. 14, 2002

(30) Foreign Application Priority Data

Jul. 5, 2000 (DE) ..... 100 32 517

(51) Int. Cl.[7] ..... F02M 45/10; F02M 59/00; F02M 61/00; B05B 1/30

(52) U.S. Cl. ..... 239/96; 239/533.2; 239/533.3; 239/585.5; 239/585.1

(58) Field of Search ..... 239/96, 95, 88, 239/89, 90, 91, 93, 533.2, 533.3, 533.8, 533.9, 533.12, 585.1, 585.2, 585.3, 585.4, 585.5

(56) References Cited

U.S. PATENT DOCUMENTS 5,127,583 A * 7/1992 Taue ..... 239/96
5,241,935 A * 9/1993 Beck et al. ..... 123/300
5,484,104 A * 1/1996 Kukler ..... 239/87
5,641,121 A * 6/1997 Beck et al. ..... 239/92
5,685,483 A 11/1997 Ganser
6,076,508 A * 6/2000 Nakano ..... 123/490
6,113,000 A * 9/2000 Tian ..... 239/88
6,227,174 B1 * 5/2001 Hedrick et al. ..... 123/495
6,394,073 B1 * 5/2002 Binkele et al. ..... 123/506

FOREIGN PATENT DOCUMENTS

| | | |
|---|---|---|
| DE | 195 12 730 C1 | 8/1996 |
| DE | 196 12 738 A1 | 10/1996 |
| DE | 196 21 583 A1 | 1/1997 |
| DE | 197 01 879 A1 | 7/1998 |
| WO | WO 01/11222 A1 | 2/2001 |

* cited by examiner

*Primary Examiner*—Davis Hwu
(74) *Attorney, Agent, or Firm*—Ronald E. Greigg

(57) ABSTRACT

The invention relates to an injector for injecting fuel into combustion chambers of an internal combustion engine. A control part is provided in the housing of the injector and protrudes into a control chamber, in which a control volume is enclosed. The control chamber can be pressure-relieved via an actuator. In the housing of the injector body, the control part is acted upon by spring elements. The control part is guided in a guide sleeve that defines the control chamber.

10 Claims, 1 Drawing Sheet

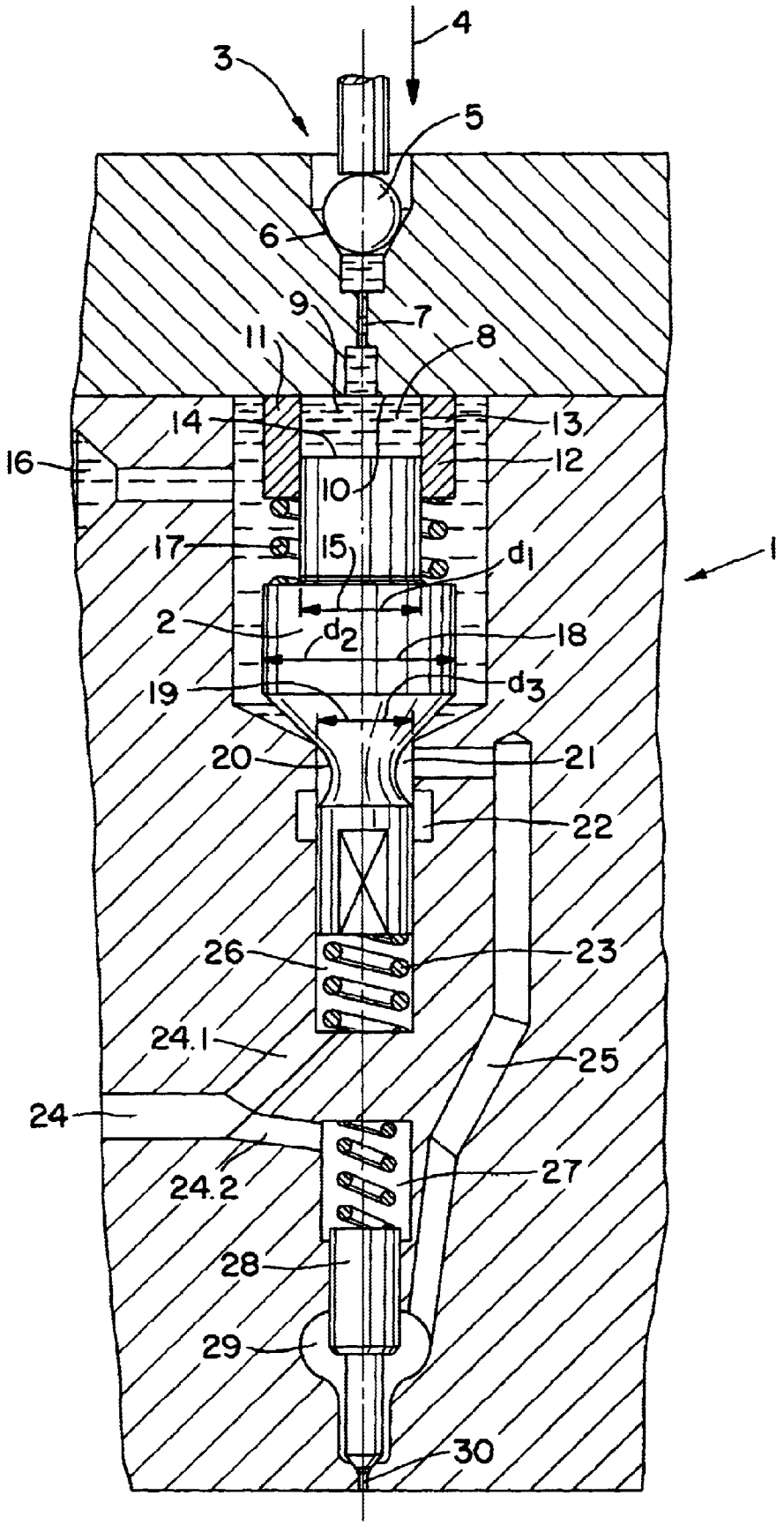
4
3
5
6
9
7
11
8
14
13
16
12
10
17
15
$d_1$
1
2
$d_2$
18
19
$d_3$
20
21
22
26
23
24.1
25
24
24.2
27
28
29
30

INJECTOR WITH CONTROL PART GUIDANCE

BACKGROUND OF THE INVENTION

1. Field of the Invention

In injectors for injecting fuel into combustion chambers of internal combustion engines, control parts are used that, by triggering of an actuator, can be moved into a closing and an opening position. The control parts of the injectors are guided on guide faces, by spring action in the injector body.

2. Description of the Prior Art

From German Patent Disclosure DE 198 35 494 A1, a unit fuel injector has been disclosed. It serves to deliver fuel to a combustion chamber of direct-injection internal combustion engines to build up an injection pressure and to inject the fuel, which is at high pressure, into the combustion chamber via an injection nozzle. A control part includes a control valve, which is embodied as an outward-opening valve, and a valve actuation unit for controlling the pressure buildup in the pump unit. To create a unit fuel injector with a control part that has a simple structure, is small in size, and in particular has a short response time, the valve actuation unit assigned to the unit fuel injector is embodied as a piezoelectric actuator.

From German Patent DE 37 28 817 C2, a fuel injection pump for an internal combustion engine has been disclosed. It includes a pressure part for subjecting the fuel to pressure and a nozzle part for injecting the pressurized fuel. Between the pressure part and the nozzle part, there is a control part, which includes a fuel supply line, which connects the pressure part to the nozzle part, and a cylindrical conduit whose center axis intersects the fuel supply line. One end of the conduit is embodied as a control bore that changes into an opening communicating with a fuel return conduit. A control valve member is provided in the conduit; by means of an electrical actuation device, it can be moved between an open position, in which the fuel supply and the fuel return conduit communicate via the control bore, and a closing position in which the control bore is closed. The actuating device includes an adjustable-length piezoelectric element, which is connected to a drive piston. The free end face of the drive piston is separate from and opposite a considerably smaller end face of a drive tappet that mechanically adjusts the control valve member; a passageway connecting the hollow chamber to the fuel return conduit is embodied in the drive tappet. Provided in this passageway is a check valve, which closes the passageway when the pressure in the hollow chamber exceeds the pressure in the fuel return conduit and opens the passageway when the pressure in the hollow chamber is less than the pressure in the fuel return conduit.

OBJECT AND SUMMARY OF THE INVENTION

With the embodiment proposed by the invention, an injector design can be achieved which instead of two guide surfaces for one control part in the injector housing and two corresponding guide faces on the control part requires only one pair of guide faces on the control valve and the injector housing. The injector housing can thus be produced substantially more simply from a production standpoint and inexpensively with regard to the disposition of guide faces that are positioned exactly coaxially to one another and aligned. Only two cooperating guide faces with high demands made of the machining quality of the surfaces are required in the valve housing and on the control part movable in it, which reduces the production costs not inconsiderably.

By means of an advantageous disposition of a spring element between the guide sleeve and the control part, sealing off of the control chamber on the one hand and centering of the guide sleeve in the first diameter range of the control part on the other can be attained by prestressing the guide sleeve in the injector housing by means of the positioning force. An extremely advantageous feature from a production standpoint is that the guide sleeve need not be connected to the housing of the injector; the simple plane contact of a flat seat of the guide sleeve with a plane face of the housing of the injector is entirely adequate to seal off the control chamber upon subjection of the guide sleeve to spring force. The wall of the guide sleeve can be embodied in the simplest possible way from a production standpoint, with an inlet throttle for the control chamber volume entering the control chamber, the inlet throttle for instance being in the form of a bore that penetrates the wall of the guide sleeve.

The guide sleeve functioning as a sealing element serves as a boundary of the control chamber, on whose boundary wall toward the opening the relief opening for pressure relief is embodied by means of a triggerable actuator valve. This valve can be embodied preferably as an outlet throttle, which is actuated via an actuator, by which a closing element can be triggered. As actuator elements, electromagnets or mechanical-hydraulic boosters are also conceivable.

BRIEF DESCRIPTION OF THE DRAWING

The invention will be better understood and further objects and advantages thereof will become more apparent from the ensuing detailed description taken in conjunction with the drawing, which is a longitudinal section through an injector of the invention.

DESCRIPTION OF THE PREFERRED EMBODIMENTS

In the drawing, a longitudinal section through the injector proposed by the invention is shown. A control part 2 is supported in the housing of an injector 1, rotationally symmetrically to the axis thereof. In the upper region of the injector housing, a control element 3 is provided, which acts upon a closing element 5, embodied spherically, for instance, in the effective actuator direction 4 by means of a pressure piston. As a result, the closing element 5 is pressed into its seat 6 in the housing of the injector 1, so that the pressure prevailing in the control chamber 8 of the injector housing cannot be relieved through the outlet throttle 7.

As the control element 3, a piezoelectric actuator, an electromagnet, or a mechanical-hydraulic booster can be used, to name only a few possible embodiments as examples.

In the housing of the injector, a hollow chamber is provided, which can be subjected to fuel at high pressure via an inlet 16 from the high-pressure collection chamber (common rail). The communication of the inlet 16 with the common rail located outside the injector is not shown in detail in the drawing. Through the inlet 16 from the common rail, the hollow chamber in the housing of the injector 1 is filled with fuel.

The control part 2 protrudes into the interior of the hollow chamber and is embodied in the region of the hollow chamber with two diameter ranges.

In the first diameter range, identified by reference numeral 15 in the drawing or designated by the diameter indication $d_1$, the control part is surrounded by a spring element 17. The spring element is braced on one side on a collar of the control part 2. The collar is embodied in a second diameter range 18 with a larger diameter $d_2$. On the opposite end of the closing spring 17, this spring is braced on an annularly embodied guide sleeve 11, which in turn is braced with a flat seat on a plane face of the housing of the injector 1. By the action of the closing spring 17, designed as a compression spring, the guide sleeve 11 provided with a flat seat is always pressed against the upper wall of the housing of the injector 1, and as a result a sealing action is developed between the flat seat of the guide sleeve 11 and the inner part of the guide sleeve 11 that acts as a control chamber 8.

With its first diameter range 15 ($d_1$) and a face end 14 embodied on it, the control part 2 protrudes into the control chamber 8, in which there is a control volume 9 which is always filled, via fuel made available via the inlet 16 from the common rail, with a fuel supply that prevails continuously in the control chamber 8, via a bore, acting as an inlet throttle 13, in the wall 12 of the guide sleeve 11.

Adjoining the second diameter range 18 of the control part 2, embodied with the diameter $d_2$, is a conically embodied tapered portion which changes over, at the seat diameter 19 of the control part 2, to a third diameter $d_3$. The third diameter range, with the diameter $d_3$, of the control part 2 is adjoined by a constriction 20, which is embodied on the control part 2 and forms the boundary toward the control part of a valve chamber 21. Toward the housing, the valve chamber 21 is defined by the bore diameter $d_3$, into which a nozzle inlet line 25 discharges, which line extends in the injector housing, approximately parallel to the axis of symmetry of the injector housing, toward the nozzle chamber 29.

In the injector housing below the control part 2, there is a hollow chamber 26 toward the control part, in which a compression spring element 23 is disposed. The compression spring element 23 is braced on one end on an end face of the hollow chamber 26 toward the control part, while with its opposite end it rests on the lower face end of the control part 2. Also embodied in the housing of the injector 1 is a hollow chamber 27 on the nozzle side, once again with a spring element let into it. This spring element is braced on one end on a wall of the hollow chamber 27 toward the nozzle, perpendicular to its axis of symmetry, and on the other end on the face end of a nozzle needle 28. The nozzle needle 28 protrudes with its narrowed end into the nozzle chamber 29, which is supplied with fuel that is at extremely high pressure via the nozzle inlet 25. At a nozzle opening 30, the nozzle chamber 29 discharges into a nozzle bore, which in turn protrudes into the combustion chamber of an internal combustion engine.

The two hollow chambers 26 toward the control part and 27 toward the nozzle are each connected via a respective branch 24.1 to a leaking oil outlet 24 that relieves these hollow chambers of leaking oil. Via the leaking oil line 24, which is supplied with leaking oil via the branches 24.1, 24.2, the leaking oil is either fed back into the fuel tank of the motor vehicle or collected at some other location in the injection system.

The mode of operation of the injector, shown in longitudinal section in the drawing, for common rail applications in direct-injection internal combustion engines is as follows:

Upon pressure relief at the actuator 3 counter to its effective actuator direction 4, as a result of the high pressure of the control volume present in the control chamber, the closing element 5 now relieved by the actuator moves out of its seat face. As a result, a fuel volume 9 that is under extremely high pressure in the control chamber 8 flows out through the outlet throttle 7 via the seat face 6 of the closing element. As a result, the pressure in the control chamber 8 drops, causing the control part 2 to move, with its first diameter range 15 (diameter $d_1$) with the face end 14 leading, into the control chamber 8. In this insertion motion, the closing spring element 17 is compressed, so that the guide sleeve 11, acting as a guide face, always remains pressed, with sealing action, against the plane contact face in the housing of the injector, and no control volume 9 can escape from the control chamber 8 via this sealing face.

The insertion motion of the first diameter range 15, designated as diameter $d_1$, into the control chamber 8 at the housing of the injector 1 causes an opening of the control part 2 at the third diameter range 19, embodied with a seat diameter $d_3$. By the resultant vertical motion of the control part 2, the inlet 16 from the high-pressure collection chamber (common rail) is made to communicate with the valve chamber 21 in the housing of the injector 1. Fuel under extremely high pressure shoots into the valve chamber 21, which is defined on one side by a bore wall in the housing of the injector 1 and on the other is embodied by a constriction 20, which begins at the control part 2 below the third diameter range 19. When the control part 2 opens, that is, when the seat diameter 19 is uncovered, the control edges of the leaking oil slide 22 move upward vertically and thus definitively preclude a spillover of fuel, emerging at extremely high pressure from the inlet 16 from the common rail, directly into the hollow chamber 26 toward the control part, so that the fuel under high pressure entering the valve chamber 21 can be introduced directly into the nozzle chamber 29 via the nozzle line 25, which can be embodied for instance as a bore in the housing of the injector 1. Thus the fuel, injected at extremely high pressure, prevails maximally free of loss in the nozzle chamber 29 of the injector 1, since the valve chamber 21 is sealed off from the hollow chamber 26 toward the control valve by the upward motion of control edges of the leaking oil slide 22.

As a result of the nozzle needle 28 supported movably in the housing of the injector 1, fuel in chamber 29 that is at high pressure reaches the hollow chamber 27 toward the nozzle, and from there the fuel enters a leaking oil line 24 via a leaking oil branch 24.2. The same is true for the hollow chamber 26 provided toward the control part, in which chamber a spring element 23 acting upon the control part 2 is disposed. From there, the branch 24.1 also branches off and carries leaking oil out of this hollow chamber into the leaking oil line 24. By upward motion of the nozzle needle 28 upon action on the nozzle chamber 29, the nozzle opening 30 on the end of the injector 1 protruding into the combustion chamber of an engine is uncovered, so that the fuel can be injected, suitably metered, into the combustion chamber.

By the disposition of the guide sleeve 11, which in its inside diameter is centered on the control part 2 in the first diameter range 15 with the diameter $d_1$ thereof, a possible guidance of the control part 2 in the injector that is simple to achieve from a production standpoint is feasible. The guide sleeve 11 is acted upon as a component, by action by the spring element 17 when the control chamber 8 is pressure-relieved, via the triggerable actuator 3 in such a way that a sealing action ensues at the flat seat of the guide sleeve 11 in the housing of the injector 1. The control part 2 is now on the one hand guided reliably in the housing of the injector 1. On the other, the control chamber formed by the guide sleeve 11 is reliably sealed off against leakage. In addition, the guide faces of the control part 2, that is, the inside of the guide sleeve 11, are decoupled from the first diameter range 15 on the control part 2 by the guide faces of the nozzle needle 28 in the housing of the injector 1. As a result, simpler and hence more economical production of the injector 1 of the invention, shown in longitudinal section in the drawing, is also feasible. The 3/2-way control part 2 is guided on the guide sleeve 11, which is not connected to the housing of the injector, or which need not even be embodied thereon, but instead via a spring element 17 in its flat seat on the housing of the injector 1 rests in such a way that it performs multiple functions. On the one hand, upon pressure relief of the control chamber 8, the guide sleeve 11, by means of the spring element 17 acting on it, seals off, and on the other hand, the wall 12 of the guide sleeve 11 serves to receive a throttle element 13, and finally, the inside bore of the guide sleeve 11, which bore is machined with a higher surface quality, serves as a guide for the first diameter range 15 (diameter $d_1$) of the control part 2 in its vertical motion upon pressure relief of the control chamber 8 and uncovering of the seat diameter 19 toward the valve chamber 21 in the housing of the injector 1.

The foregoing relates to preferred exemplary embodiments of the invention, it being understood that other variants and embodiments thereof are possible within the spirit and scope of the invention, the latter being defined by the appended claims.

I claim:

1. An injector for injecting fuel into combustion chambers of internal combustion engines, the injector compressing a control part (2) which is movable in a housing and protrudes into a control chamber (8) that can be pressure-relieved via an actuator (3), said control part (2) being acted upon in the housing of the injector (1) by spring elements (17, 23), the control part (2) being guided in a guide sleeve (11) that defines the control chamber (8).

2. The injector according to claim 1, wherein the guide sleeve (11), acted upon by means of the spring element (17), rests on a housing wall (10) of the injector (1).

3. The injector according to claim 2, wherein the spring element (17) is braced on one end on the guide sleeve (11) and on the other rests on a second diameter range (18) of the control part (2).

4. The injector according to claim 2, wherein the guide sleeve (11) serves as a seal for the control volume (9) enclosed in the control chamber (8).

5. The injector according to claim 1, wherein the guide sleeve (11) is centered on the control part (2), on its first diameter range (15) (diameter $d_1$).

6. The injector according to claim 1, wherein the wall (12) of the guide sleeve (11) is penetrated by an inlet (13) into the control chamber (8).

7. The injector according to claim 6, wherein the inlet is embodied as an inlet throttle (13).

8. The injector according to claim 1, wherein the inlet (16) from a common rail into a hollow chamber that receives the guide sleeve (11) and the spring element (17) bracing the guide sleeve discharges in the housing of the injector (1).

9. The injector according to claim 1, wherein the guidance of the nozzle needle (28) in the housing of the injector (1) is separate from the guidance of the control part (2) in the housing of the injector (1).

10. The injector according to claim 1, wherein hollow chambers (26, 27) which have a common outlet-side leaking oil line (24; 24.1, 24.2) are provided in the housing of the injector (1).

* * * * *